United States Patent [19]

Hinderling

[11] Patent Number: 4,771,865

[45] Date of Patent: Sep. 20, 1988

[54] SYSTEM FOR THE REMOTE MANAGEMENT OF ELEVATOR INSTALLATIONS

[75] Inventor: Thomas Hinderling, Ebikon, Switzerland

[73] Assignee: Inventio AG, Switzerland

[21] Appl. No.: 74,631

[22] Filed: Jul. 17, 1987

[51] Int. Cl.[4] ..... B66B 3/00

[52] U.S. Cl. ..... 187/130; 187/133

[58] Field of Search ..... 187/100, 101, 121, 124, 187/130, 133, 139

[56] References Cited

U.S. PATENT DOCUMENTS

| | | | |
|---|---|---|---|
| 3,973,648 | 8/1976 | Hummert et al. | 187/133 |
| 4,418,795 | 12/1983 | Trosky et al. | 187/130 |
| 4,491,198 | 1/1985 | Noda et al. | 187/130 |
| 4,512,442 | 4/1985 | Moore et al. | 187/133 |
| 4,568,909 | 2/1986 | Whynacht | 187/133 |
| 4,698,780 | 10/1987 | Mandel et al. | 187/130 X |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A system for remote management includes central management, planning and rationalization of the upkeep of elevator installations. The system comprises a modularly constructed remote management system, which makes possible the management centrally, the inspection regionally and the monitoring of decentralized processes locally of elevator installations. The management exchange is connected by modem and telephone network with the regional exchanges and has access to all relevant data. The regional exchange permits an inspection of all processes of several buildings. Direct speech connections with all the peripheral devices are by means or remote alarms from the regional exchange. For each building, a communications module manages the data traffic between the regional exchange and the processes to be inspected in the building. The process data is detected by a peripheral module, which is capable of diagnosis, and is processed further into relevant operational, fault and alarm reports with the aid of heuristic operating means. The peripheral module reports diagnostic data by way of the common building bus to the communications module, which transmits the data to the regional exchange by means of automatic telephone dialing.

18 Claims, 5 Drawing Sheets

10.11
BINARY INPUT
10.7
11.1
BINARY OUTPUT
10.8
11.2
11
ANALOG INPUT
10.9
11.3
ANALOG OUTPUT
10.10
11.4
PERIPHERAL COMPUTER
10.1
10
RAM
10.2
EPROM
10.3
CLOCK PULSE
10.4
SERIAL INTERFACE
10.5
13
SERIAL INTERFACE
10.6
15
MAIN BUS
14
8.3
8.1
8
8.2
12
5

SYSTEM FOR THE REMOTE MANAGEMENT OF ELEVATOR INSTALLATIONS

BACKGROUND OF THE INVENTION

The invention relates to an elevator monitoring system in general and, in particular, to a system for the central management, regional inspection and local monitoring of decentralized elevator installations.

From U.S. Pat. No. 3,973,648, a system is known which, by way of modem connection, monitors elevator groups by means of a central computer. An elevator group selected by the central computer sends data concerning operational, fault and alarm events in serial digital form to the central computer. A hardware interface with monitoring and transmission functions serves as a connecting member between the elevator group and the central computer.

The disadvantage of this prior art system lies in that the data is passed on unevaluated. The central computer must evaluate the incoming data and decide whether a service action is indicated by reason of the evaluation. The transmission of all actual installation data to the central computer requires a long occupation of rented telephone lines and demands much computer time. A further disadvantage of this system lies in that the central computer calls up the elevator groups to be monitored. Thereby, the relevant installation data is detected not when it arises, but with a delay caused by the interrogation cycle. Beyond that, inquiries occur, at least in the case of small traffic frequencies, when no substantial changes concerning installation data are present.

From U.S. Pat. No. 4,512,442, a system is known which comprises means for the remote monitoring of elevator systems. The data points of an elevator system, which are to be monitored, are connected to an auxiliary computer subordinate to a main computer. For each elevator group, an intelligent, in situ main computer receives the data of the auxiliary computer as well as the data of the elevator group control. This data is prepared by the main computer and passed by way of a modem connection to the central computer. The central computer compiles upkeep lists from the received data and transmits the lists to the responsible service point.

The disadvantage of this prior art system lies in that all data of an elevator group is prepared and transmitted by means of a main computer. In the case of a fault or in the case of a service requirement (maintenance of the software and so forth) of the main computer, the remote monitoring of the entire elevator group fails. A further disadvantage of the known equipment lies in that a modem connection to the central computer is necessary for each main computer. In buildings with several elevator groups, several communication lines to the main computers placed in the machine room must therefore be installed and rented.

From U.S. Pat. No. 4,568,909, a system is known which comprises means for the local and central remote monitoring of elevator systems. For each building, a main computer by means of auxiliary units detects the data of several elevator systems. The main computer evaluates the data and decides whether new operational, fault and alarm events are present. It transmits the events by way of a modem connection to a local service point. Several service points are connected to one superordinate central computer.

The disadvantage of this system lies in that the computer intelligence for an entire building is concentrated in a main computer. Only the combination of auxiliary units with the main computer results in a functionally capable monitoring system. Such a monitoring system has proven to have little flexibility for being expanded, is complicated in terms of hardware and software and is expensive in terms of costs.

SUMMARY OF THE INVENTION

The invention concerns a system for the remote management of elevator installations. The system performs new service operations for the client with the aim of simplifying the upkeep of elevator installations by means of central management, planning and rationalization. The invention is based on the task of building up an efficient remote management system from simple means and with the utilization of already existing equipment, which system detects decentralized processes of elevator installations on a regional plane and manages them centrally on a super-regional plane. A process comprises all operations in elevator installations to be monitored and falling under the term of elevator technique.

The prior art problems are solved by the invention which is a system for the remote management of elevator installations. The system includes a management exchange in a modular structure on a management plane, which exchange has means and methods for electronic data processing and has arranged subordinate thereto, by way of a communications connection, at least one regional exchange on a regional plane. The regional exchange is provided with means and methods for guaranteeing the installation upkeep and is connected by way of a communications connection on local plane with at least one building with computer means for the diagnosis of installation activities of at least one elevator installation.

Such equipment makes possible a rationalization of the upkeep, a reduction of upkeep costs and an improved availability in service performance in elevator installations. The remote management system for each process on the process plane displays an intelligent in situ peripheral device, capable of diagnosis, for the autonomous monitoring of a process. The peripheral device comprises means for process data detection, means for process data treatment and means for the specific adaptation to the process. The peripheral device reports diagnostic data at the regional exchange by way of a communications computer present in each building. All important details of the maintenance activities are the responsibility of the regional exchange. The regional exchanges of a geographical region are in communication with a superordinate management exchange which thus has access to all relevant data arising in the system and is used for central management activities. The communication paths within the building are the electrical lines present throughout the building, and outside the building are the telephone lines present throughout the land.

The advantages attained by the invention are, for each process, that an intelligent peripheral device adaptable to the process is provided for the separating out of operational, fault and alarm events. Thereby, flexible remote management systems, detecting each process of elevator installations, are realized with modular build-up. Minimum plant and installation costs result through the use of the simplest means with utilization of electrical installations and telephone lines as communication paths. The optimum maintenance of elevator installations, which is attained through the remote management system, makes possible substantial savings in personnel and operational costs.

BRIEF DESCRIPTION OF THE DRAWINGS

The above, as well as other advantages of the present invention, will become readily apparent to those skilled in the art from the following detailed description of a preferred embodiment when considered in the light of the accompanying, drawings in which.

DESCRIPTION OF THE PREFERRED EMBODIMENT

Figure 1:
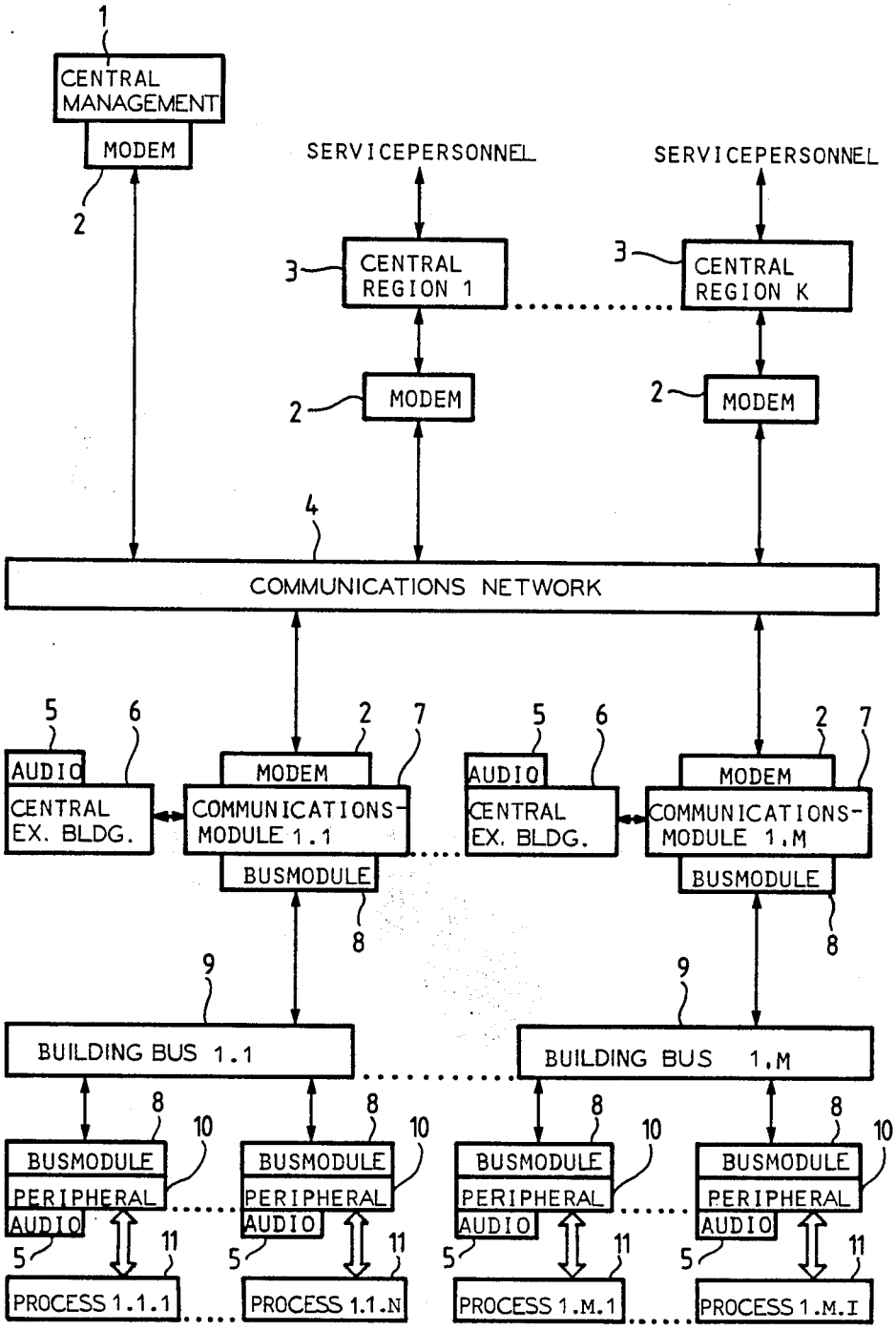
FIG. 1 is a block diagram of a system according to the present invention for the remote management of elevator installations.
Figure 2:
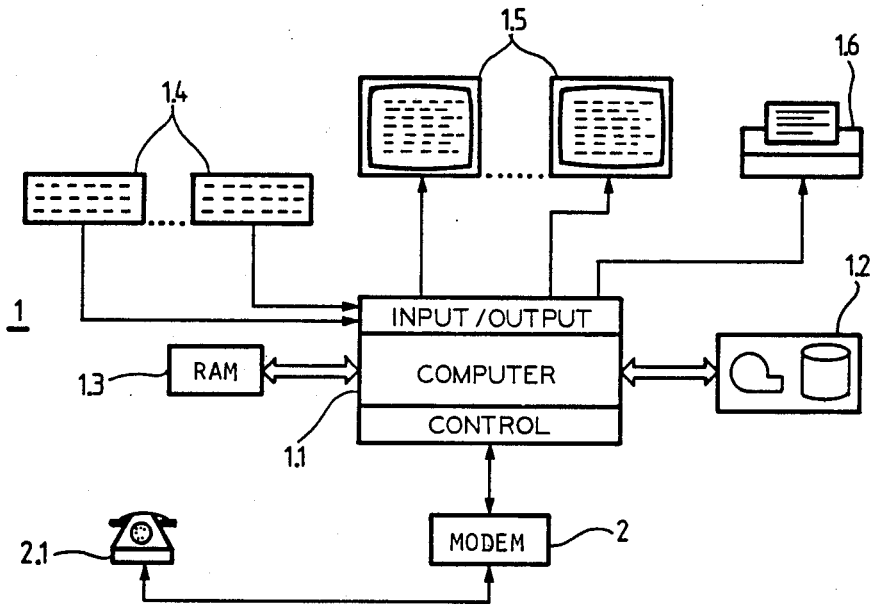
FIG. 2 is a block diagram of a management exchange as shown in FIG. 1.
Figure 3:
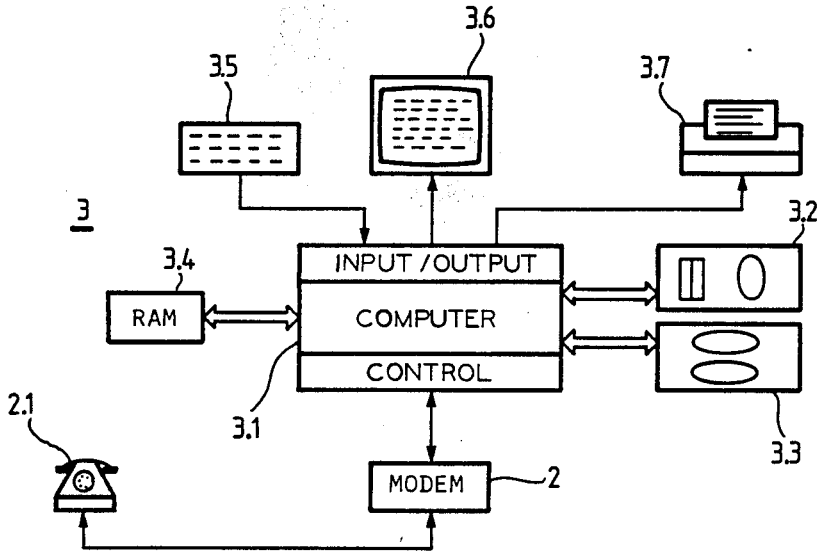
FIG. 3 is a block diagram of a regional exchange as shown in FIG. 1.

Designated by 1 in FIGS. 1 and 2 is a central management exchange, which includes a central processor or computer 1.1, a mass storage device such as a computer disc or tape drive 1.2, a working storage device 1.3 such as a random access memory (RAM), at least one data input device such as a keyboard 1.4 for information input, as well as at least one data display device 1.5 such as a cathode ray tube (CRT) and at least one output device such as a printer 1.6 for information output. The management exchange 1 is connected by way of a modem 2 and a telephone connection 2.1 of a public telephone network 4 with at least one central regional exchange 3. The indices used in FIG. 1 signify the following from left to right: region, building and process. For example, "1.M.I" signifies process "I" in building "M" of the region "1". The regional exchange 3, as shown in FIG. 3, includes a central processor or computer 3.1, a floppy disc drive 3.2, a hard disc drive 3.3, a RAM 3.4 and peripheral devices such as a keyboard 3.5, a data display device 3.6 and an alarm printer 3.7 and differs in equipment only insubstantially from the management exchange 1. In terms of size, the exchanges differ insofar as the management exchange 1 must meet wide electronic data processing applications while the regional exchange 3 is provided substantially only for the instruction of the service personnel.

Figures 4, 5:
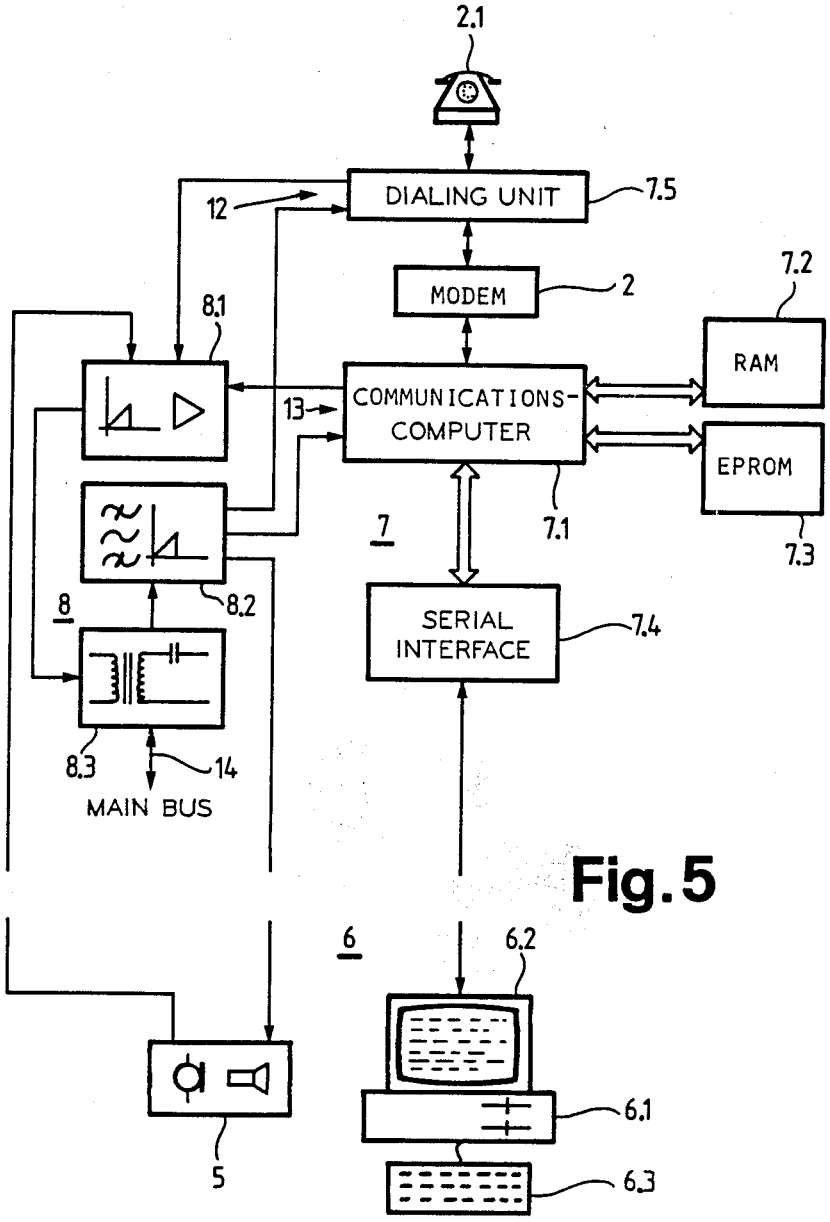
FIG. 4 is a block diagram of a communications module with an associated bus module as shown in FIG. 1.
FIG. 5 is a block diagram of the elements of a building exchange as shown in FIG. 1.

A remote alarm device such as a speaker or horn 5 together with a commercially available personal computer 6.1, which is equipped with a usual data display device 6.2 and a keyboard 6.3, serve for the monitoring of a central exchange building 6 as shown in FIG. 5. A communications module 7, consisting of a communications computer 7.1, a RAM 7.2 and a communications program storage device such as an erasable and programmable read only memory EPROM 7.3, is responsible for the data exchange between the building and the outside world as shown in FIG. 4. The building exchange 6 is connected by way of a serial interface 7.4 to the communications module 7. A selector or dialing unit 7.5 distinguishes incoming or outgoing data from incoming or outgoing calls of the remote alarm 5.

Figure 6:
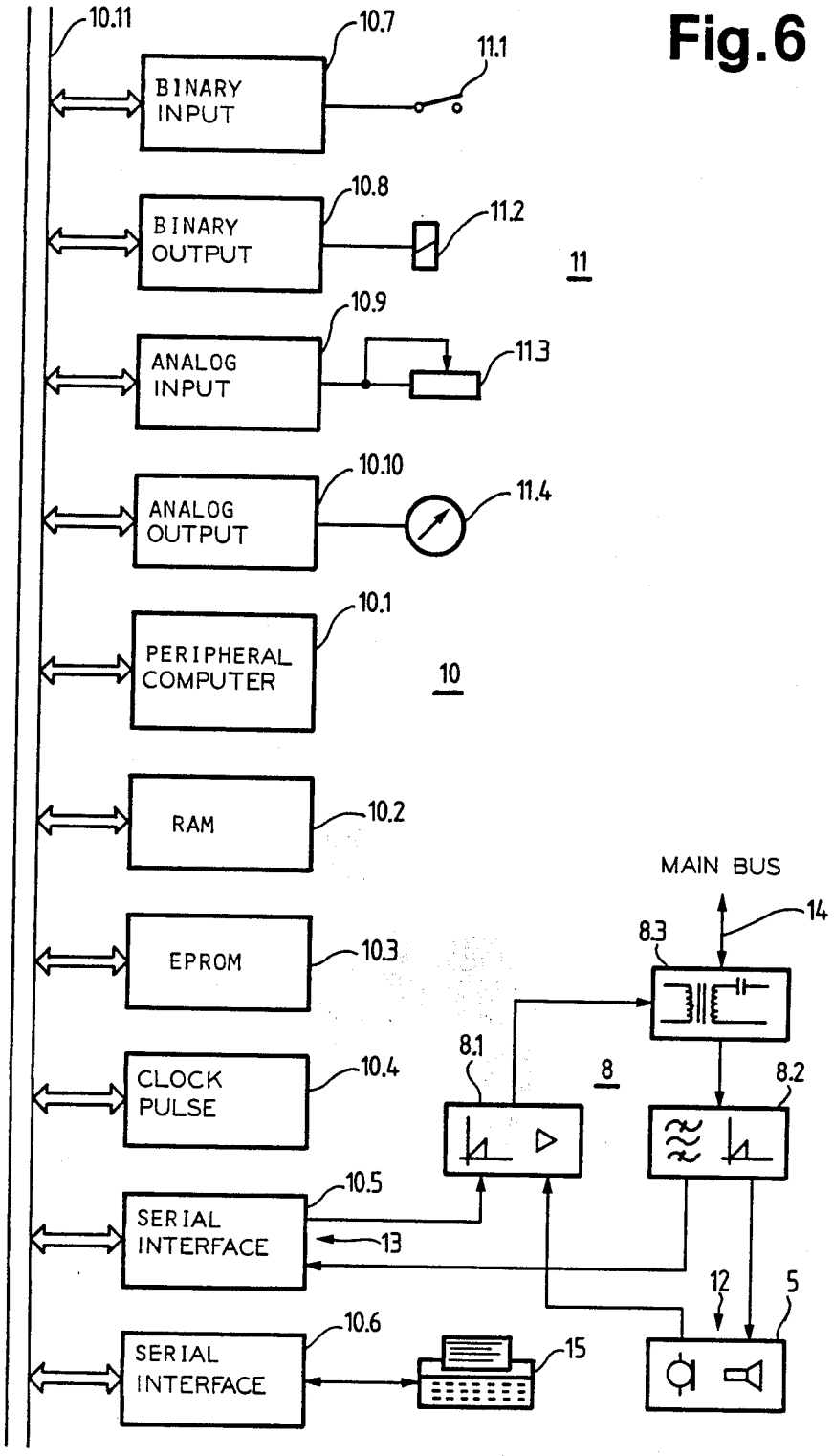
FIG. 6 is a block diagram of a peripheral module, as shown in FIG. 1, with an associated bus module and process elements connected to the peripheral module.

A bus module 8 takes over the translation in terms of frequency of outgoing or incoming data or calls in a modulator 8.1 and a demodulator 8.2 and sends or receives the data or calls by way of a line coupler 8.3 onto or from a building bus 9 as shown in FIG. 1. A peripheral module 10, as shown in FIG. 6, includes a peripheral computer 10.1, a RAM 10.2, an EPROM 10.3 for program storage and a time or clock pulse generator 10.4. The peripheral module 10 is connected by way of a serial interface 10.5 to the bus module 8. A second serial interface 10.6 makes an in situ communication with the peripheral module 10 possible for the service personnel.

For data detection and for data exchange, the peripheral module 10 includes at least one binary input 10.7, at least one binary output 10.8, at least one analog input 10.9 and at least one analog output 10.10. Within the peripheral module 10, a common peripheral bus 10.11 is connected to all of the previously mentioned devices 10.1 through 10.10. The data generated by a process 11 and the commands necessary for the process 11 are detected by or transmitted to the process 11 by means of at least one binary data point 11.1, by means of at least one binary function 11.2, by means of at least one analog data point 11.3 and by means of at least one analog function 11.4. A speech channel is designated by 12 and a data channel is designated by 13. A main bus 14 is a variant of the embodiment of the building bus 9 illustrated in FIG. 1. Through the connection of a portable maintenance unit 15 to the interface 10.6, the above-mentioned in situ communication is made possible.

Figure 7:
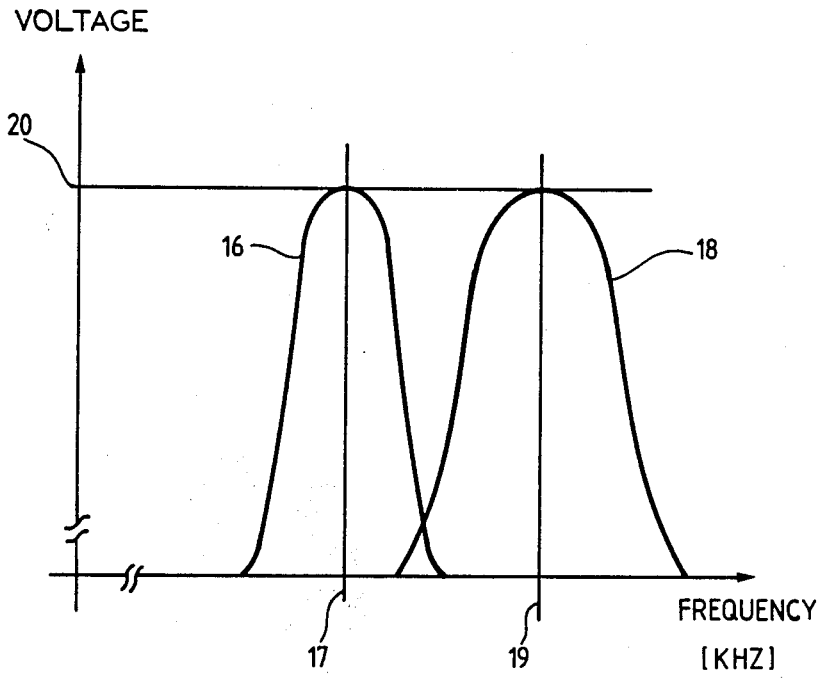
FIG. 7 is a voltage-frequency diagram in connection with the building bus shown in FIG. 1.

The voltage-frequency diagram illustrated in the FIG. 7 indicates a data channel width 16 at a data carrier frequency 17. In an analogous manner, a speech channel bandwidth 18 at a speech carrier frequency 19 is illustrated for the speech channel 12. A carrier frequency amplitude 20 applies to the speech channel 12 as well as to the data channel 13.

The afore-described equipment operates as follows:

The system, illustrated in FIG. 1, for the remote management of elevator installations, is divided hierarchically and functionally into four planes: a management plane, a regional plane, a building plane and a process plane. The modular structuring of the system permits a far reaching independence of the individual planes. Each subordinate plane is also capable of functioning without the plane superordinate to it. Without the management exchange 1, the system still operates as a remote inspection system. Without the regional exchange 3, the system remains fully capable of functioning as an inspection system for the processes connected throughout the building. Without the building exchange 6, each individual process 11 can be monitored by means of the peripheral device 10 and the portable maintenance unit 15.

The management exchange 1 has the task of managing the actions which are necessary to the upkeep of elevator installations of several regions, centrally and in a commercially efficient manner. For this purpose, it is connected by way of the modem 2 and the telephone network 4 with the regional exchanges 3 of the geographical regions "1" to "K". The data relevant to management is separated out by the regional exchanges 3 and transmitted with the aid of known means and methods of data communication to the management exchange 1. In the management exchange, equipped with commercially available devices, substantially the following electronic data processing applications are performed: computations, cost analysis, optimization of maintenance, maintenance interval calculations, weak point analyses, trend analysis and control of modernizing actions. The operating methods necessary for the system correspond to the current state of the electronic data processing art and are therefore not explained in more detail.

The regional exchange 3 serves as an interface between the system and the service personnel responsible for the installation upkeep of an entire region. In the exchange 3, the process data is manipulated and generated in clear text to the user. The regional exchange 3 of the geographical region "1" is connected by way of the modem 2 and the telephone network 4 with the buildings "1.1" to "1.M". In terms of order, the regional exchange 3 of the geographical region "K" is superordinate to the buildings "K.1" to "K.M". In each regional exchange 3, operating, fault, alarm, danger, maintenance and safety reports are detected from the processes 11 associated with it. The central processor, controlled from the operating system and application program resident in hard disc storage 3.3, processes the detected data further for the following purposes: record-keeping, reliability statistics, efficiency analysis, mission planning of the service personnel, route planning of the service personnel, replacement part planning and preventive maintenance planning by reason of the detected operational and upkeep data. Data of second order priority is stored in the floppy disc drive 3.2 and generated by the printer 3.7 on call-up.

In addition to the transmission of digital information, the system possesses the capability of transmitting audio information. On a speech channel separated in terms of frequency from the data channel, the operator of a regional exchange 3 has the capability of entering into direct contact with persons participating in a process 11. By means of the remote alarm 5, the operator of a building exchange or the in situ service technician can orally request support from the regional exchange 3 in the solving of installation problems. Transmitting and receiving means are provided at the elevator mounted directly in the cage. Persons, who require help, can thereby communicate their situation directly to the building or regional exchange.

The regional exchange 3 permits an inspection of all processes 11 subordinate to it. Through generation of a request with control and address data of the peripheral device 10 to be selected, the regional exchange 3 can obtain direct access to the process data. In the normal case, the data exchange will however take place, as mentioned further below, in the reverse direction. The regional exchange 3 calls a communications module 7 only when a predetermined time has lapsed without contact. From the regional exchange 3, functional tests in individual processes 11 can be performed and actions for the removal of the fault state can be initiated in the fault case. For these reasons, the modem 2 must be self-selecting as well as also self-responsive. Beyond that, it must meet the requirements of the remote alarm 5. By an additional circuit, which is placed in the regional exchange 3 and not shown in the figures, speech connections with the building exchange 6 or the individual peripheral devices 10 can be provided in a manner comparable to the above-mentioned data channels.

At the building, the selector unit 7.5 separates the data traffic from the speech traffic in the arriving and outgoing directions. As the connecting member between the telephone network 4 and the bus module 8 on the one hand and between the telephone network 4 and the communications module modem 2 on the other hand, the selector unit 7.5 divides the information channel at the telephone network end into the speech channel 12 and the data channel 13. In the outgoing direction, the modem 2 translates the data by means of a frequency-keying process into a transmissible two-frequency signal. In the incoming direction, it converts the frequency modulated signals back again into computer-compatible one-zero signals.

For each building, a communications module 7 takes over the data traffic between the regional exchange 3 and the processes 11 to be managed in the building. The communications computer 7.1 is controlled by a communications program residing in the EPROM 7.3 and transmits the process data by way of the modem 2 and the telephone network 4 to the regional exchange 3. Functionally, the communications module serves on the one hand as the RAM 7.2 between both the asynchronous communication lines of the telephone network 4 and the building bus 9, and on the other hand for the control of the communication within the building. By sequential, periodic interrogation, the communications computer 7.1 receives the data from the connected processes 11 by way of the bus module 8 and building bus 9, explained further below, and stores this data in the RAM 7.2. In that case, not only is a data interrogation performed, but on each contact with the peripheral modules 10, they are tested by the communications computer 7.1 in respect of fault behavior. Reports about disturbed peripheral modules 10 are likewise deposited in the RAM 7.2 and together with the collected process data are transmitted periodically to the regional exchange 3. The communications module 7 does not decide whether process data is relevant to transmission or not. It merely supervises the above-mentioned data traffic between the in situ peripheral device 10 and the regional exchange 3. Process reports are prepared exclusively by the peripheral modules 10 as process data relevant for transmission and passed on to the communications module 7.

When no regional exchange 3 is provided or when it fails by reason of fault or when an additional monitoring from a building supervision room is desired, the processes 11 of a building can be inspected from the building exchange 6. A commercially available personal computer 6.1 is connected with the system by way of the serial interface 7.4. The building exchange 6, which also can be equipped with a printer, functionally corresponds in a simplified manner to the regional exchange 3. The data present in the RAM 7.2 is processed further by the personal computer 6.1 for the following purposes: recording of the operational, alarm and upkeep data of all processes 11 connected to the system of a building, realization of simple statistical functions and output of preventive maintenance reports held to be of first priority. From the building exchange 6, indicated for example by 1.1, not only the processes 11 (FIG. 1) indicated by "1.1.1" to "1.1.N" are being monitored, but from the regional exchange 3, functional tests and call-ups of certain process parameters in individual processes 11 are performed.

Within a building, information data is exchanged between the communications module 7 and the peripheral modules 10 by means of the bus module 8 and the building bus 9. The bus module 8 modulates outgoing speech information data onto the speech carrier frequency 19 and data information onto the data carrier frequency 17. The line coupler 8.3, consisting substantially of transmitter and resonance circuits, transfers the frequency modulated signals onto the building bus 9. Information arriving from the building bus 9 is transferred by the line coupler 8.3 to the input of the demodulator 8.2, which by means of filtering and demodulation converts the information into the original form and passes it on according to the information content to the speech or the data channel.

For information transmission between information sources and information sinks, the equipment illustrated in the FIGS. 4 and 6 includes the main bus 14 as a portion of the construction of the building bus 9. In the case of already existing infrastructure in the form of communications cables, a separately laid two-core cable serves as the building bus 9 in place of the main bus 14. The main bus 14 is a serial bus with utilization of the electrical power current installation present throughout the building. It requires no separate line network and makes possible the feeding-in or the reception of the signals at each point, which is accessible through plug-in sockets, of the power current mains. For reasons of telecommunications sovereignty, these means for information transmission are restricted in respect of range, transmission power and channel frequencies according to federal regulations. The range is restricted in the normal case to the property, the transmission power is in the region of a few milliwatts and the permissible frequency band must lie below the long wave band. In order that no systems outside the property are disturbed or no disturbing signals from outside systems can influence the system, carrier frequency filter traps can be provided on the feed-in side.

The exchange of data between transmitters and receivers takes place on the acknowledgement principle. An active transmitter generates information in the form of messages with control, address and data symbols. Following thereupon, it expects an acknowledgement message from the called-up receiver. The information transmission is concluded only when the active transmitter has received a valid return response. As a further measure to increase the communications reliability, the signals are respectively emitted and received synchronously with the main. The zero transition region, not utilized by the phase section controls, of the phase voltages assures a largely interference-free time window in which digital data can be transmitted. The transmission methods result in a data transmission of high reliability and substantial security against foreign influence.

Each process 11 is associated with its own autonomous in situ peripheral module 10 adaptable to the specific process character. The regional exchange 3 and the peripheral module 10 are equal partners in respect of data exchange. Each can initiate a connection for the purpose of data exchange. The peripheral module 10 is, as mentioned above, requested cyclically for data exchange by the communications module 7. In that case, only events are transmitted by the peripheral module 10, i.e. the peripheral module 10 transmits no process states during the cyclical interrogations, but merely the status changes that have occurred between two cycles. Extraordinary installation states are passed on automatically and unrequested by the peripheral module 10.

The peripheral computer 10.7 detects the process data present at a binary/analog data point 11.1/11.3 by way of at least one binary/analog input 10.7/10.9. Commands and analog magnitudes are passed on to the process 11 by means of at least one binary/analog output 10.8/10.10 and at least one binary/analog function 11.2/11.4. The time generator 10.4 supplies to the peripheral computer 10.1 the operating clock pulse for the cyclical processing of the application programs loaded in the EPROM 10.3. The peripheral computer 10.1 controls the data traffic on the peripheral bus 10.11. All data sources and data sinks, which are connected to the peripheral bus 10.11 and characterized by addresses, can transmit and receive data.

A first interface 10.5 converts parallel data into serial data, determines the transmission speeds and sends the data in the direction of the communication module 7. A manner of transmission in the same sense applies in the reverse direction. A second bi-directional interface 10.6 provides for the connection of a portable maintenance unit 15, which permits in situ operation and interrogation of the peripheral module 10 as well as direct input to the respective process. For the adaptation of the different processes 11 to the standardized peripheral module 10, a conversion of the information data specific to the installation into generally valid information data is utilized. The installation-specific information associated with the data points and functions "11.X" is, for example, converted into the generally valid binary signals.

Not only information data, which is supplied by real data points, is needed for the management of elevator installations. The access by way of virtual data points takes place on the basis of values, such as operational magnitudes, traffic magnitudes, upkeep magnitudes and so forth, originating from calculations. Real as well as virtual data points are interlinked arithmetically and logically as well as dictated by conditions, limit values and so forth. An intelligent software system, not rigidly structured in advance, with the use of heuristic operating means takes over the interpretation of the information data present at the data points.

The system components of data base, knowledge base and deduction procedure form the intelligence of the peripheral module 10. The data base comprises all information data of the data points, facts, parameter magnitudes and so forth of the running process. The knowledge base contains a basic quantity of hypothetic rules which a qualified operator would apply for the manipulation of process reports. The deduction procedure interlinks data base with the knowledge base. In that case, the rules are examined with consideration of the data base information playing a part in them. The deduction procedure develops new information out of that present from the judgements made in the knowledge base, coordinations and deductions. On the failure of, for example, one relay sequence, the deduction procedure by reason of the actual information and by reason of the rules put down in the knowledge base concludes, through the failed relay sequence, which relay contact has caused the failure. By reference to the new information obtained from the first deduction step and by further rules, the search after the cause is continued until, for example, the safety switch that has remained open and cause of the failure has been found.

In accordance with the provisions of the patent statutes, the present invention has been described in what is considered to represent its preferred embodiment.

However, it should be noted that the invention can be practiced otherwise than as specifically illustrated and described without departing from its spirit or scope.

What is claimed is:

1. A system for the central management, regional inspection and local monitoring of decentralized elevator installations, which system comprises:

a management exchange in a modular structure on a management plane, which exchange has a first computer means for electronic data processing and has arranged subordinate thereto by way of a communications connection at least one regional exchange on a regional plane, which regional exchange is provided with a second computer means for guaranteeing the upkeep of elevator installations and is connected by way of a communications connection on a local plane with at least one building with a third computer means for the diagnosis of elevator installation processes on a process plane of at least one elevator installation, and due to the modular structure of the system, the regional plane remains capable of functioning without the management plane, the local plane remains capable of functioning without the regional plane and the process plane remains capable of functioning without the local plane;

means for the transmission of audio information from the regional plane to the process plane and conversely;

a building exchange provided with means for inspection of the processes present in an associated building, the third computer means for each such associated building having a communications module which regulates the data traffic on the one hand from and to the regional exchange and on the other hand within the building;

a fourth computer means for each process having an autonomous in situ peripheral module which is adaptable to the process and is provided with operating means, but is also operable from a portable maintenance unit, for the detection and processing of process data; and a building bus, as communication means internal to the building, for the transmission of speech and data information and a bus module connected between said building bus and each process peripheral module.

2. The system according to claim 1 wherein the building bus is a serial main bus utilizing an electrical power circuit installation present throughout the building.

3. The system according to claim 1 wherein the building bus is a serial two-wire bus served by a separately laid two-core cable as an information transmitter.

4. A remote management system for elevator installations, the elevator installations each including a plurality of processes to be monitored, inspected and managed, comprising:

a management exchange including a first data processing means connected by a first modem with a communications network for receiving and processing data from regional exchanges for management activities;

at least two regional exchanges each including a second data processing means connected by a second modem to said communications network for processing data from building exchanges for maintenance activities;

at least one building exchange for each of said regional exchanges, each building exchange including a communications module connected by a third modem to said communications network and connected by a bus module to a building bus;

a peripheral module associated with each process for receiving data from and transmitting data to the process, said peripheral module connected to said building bus by a bus module; and means for transmitting audio information between each said regional exchange and associated ones of said peripheral modules.

5. The system according to claim 4 wherein said management exchange first data processing means includes a digital computer connected to said first modem, and a mass storage device, a working storage device, a data input device, a data display device and a data output device connected to said digital computer.

6. The system according to claim 4 wherein said regional exchange second data processing means includes a digital computer connected to said second modem, and a floppy disc drive, a hard disc drive, a random access memory, a keyboard, a data display device and an alarm printer connected to said digital computer.

7. The system according to claim 4 wherein said building exchange includes a personal computer having a data display device and a keyboard connected to said communications module.

8. The system according to claim 4 wherein said communications module includes a digital computer connected to said third modem, and a random access memory, an erasable and programmable read only memory, and a serial interface connected to said digital computer.

9. The system according to claim 8 wherein said building exchange includes a personal computer connected to said serial interface.

10. The system according to claim 4 wherein said communications module includes a dialing unit connected between said third modem and said communications network.

11. The system according to claim 4 wherein said bus module includes a modulator and a demodulator connected to a line coupler.

12. The system according to claim 11 wherein said building bus is an electrical power circuit existing in a building.

13. The system according to claim 11 wherein said building bus is a serial two-wire bus.

14. The system according to claim 4 wherein said means for transmitting audio information is connected to said bus modules.

15. The system according to claim 4 wherein said peripheral module includes a digital computer, a random access memory, an erasable and programmable read only memory, a clock pulse generator, a first serial interface, a second serial interface, a binary input, a binary output, an analog input and an analog output connected to a peripheral bus.

16. The system according to claim 15 wherein said bus module connected to said peripheral module is connected between said first serial interface and said building bus.

17. The system according to claim 4 wherein said second serial interface is connected to a portable maintenance unit.

18. The system according to claim 4 wherein said bus modules transmit and receive audio information at one frequency and digital information at another frequency.

* * * * *